US006394052B2

(12) United States Patent
Miyasaka et al.

(10) Patent No.: US 6,394,052 B2
(45) Date of Patent: May 28, 2002

(54) VARIABLE VALVE CONTROL APPARATUS FOR AN INTERNAL COMBUSTION ENGINE

(75) Inventors: Hideyuki Miyasaka; Masahiko Watanabe, both of Kanagawa-ken (JP)

(73) Assignee: Unisia Jecs Corporation, Kanagawa (JP)

( * ) Notice: Subject to any disclaimer, the term of this patent is extended or adjusted under 35 U.S.C. 154(b) by 0 days.

(21) Appl. No.: 09/883,281

(22) Filed: Jun. 19, 2001

(30) Foreign Application Priority Data

Jun. 22, 2000 (JP) ..... 2000-187460

(51) Int. Cl.[7] ..... F01L 1/344
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS

| | | | | |
|---|---|---|---|---|
| 5,816,204 A | | 10/1998 | Moriya et al. | 123/90.17 |
| 5,823,152 A | | 10/1998 | Ushida | 123/90.17 |
| 5,832,887 A | | 11/1998 | Adachi et al. | 123/90.17 |
| 5,943,989 A | * | 8/1999 | Kira | 123/90.17 |
| 6,105,543 A | * | 8/2000 | Ogawa | 123/90.17 |

FOREIGN PATENT DOCUMENTS

JP 10-110603 4/1998

* cited by examiner

*Primary Examiner*—Weilun Lo
(74) *Attorney, Agent, or Firm*—Sughrue Mion, PLLC

(57) ABSTRACT

A variable valve timing control apparatus for an internal combustion engine that varies the rotational phrase of the first shaft with respect to the second shaft. The apparatus comprises a housing member rotated in synchronism with one of the first shaft and the second shaft, the housing member having a circular space provided in the housing member and radially extending at least one fan-shaped space from outer circumferential surface of the circular space, a vane rotor rotated in synchronism with the other of the first shaft and the second shaft and accommodated in the housing member in order to relatively rotate with respect to the housing member, the vane rotor having radially extending at least one vane so as to divide the fan-shaped space into first chamber and second chamber. A hole provided in one of the housing member and the vane, an engaging bore provided in the other of the housing member and the vane, and a locking mechanism provided in the hole for fixing the rotational phrase between the housing member and the vane rotor. The locking mechanism comprises a locking member having a leading head provided at the one end of the locking member and a hollow space, the hollow space having an opening which opens in an opposite direction to the leading head, and a stopper member having different diameters.

22 Claims, 6 Drawing Sheets

VARIABLE VALVE CONTROL APPARATUS FOR AN INTERNAL COMBUSTION ENGINE

BACKGROUND OF THE INVENTION

This invention relates to a variable valve timing control apparatus provided in an internal combustion engine (hereinafter referred to as "an engine") to change the valve timing of intake valves or exhaust valves, thereby changing operation timing of the intake valves or the exhaust valves in accordance with engine conditions. A variable valve timing control apparatus is proposed in an engine to displace the rotational phase of a camshaft and adjust the valve timing of either an intake valve or an exhaust valve.

This type of apparatus generally is known. For example, relevant related art is disclosed in Japan publication (koukai) No. 10-110603, which is corresponding to a U.S. Pat. No. 5,832,887. This publication discloses a vane-type variable valve timing control apparatus (hereinafter referred to as "vane-type VTC" or simply "VTC") which has a housing member rotated by a crankshaft of the engine. The housing has a circular space and fan-shaped spaces protruding from a circumferential surface of the circular space. A vane rotor is accommodated in the housing member and rotates in synchronism with a camshaft. There are plural vanes protruding from the circumferential surface of the vane rotor, each vane is accommodated in each fan-shaped space and defines an advancing hydraulic chamber and a retarding hydraulic chamber. Finally, there is a hydraulic actuating means for actuating hydraulic pressure in the advanced hydraulic chambers and the retarding hydraulic chambers. The hydraulic actuating means selectively supplies the hydraulic fluid to either the advancing hydraulic chambers or retarding hydraulic chambers and discharges the hydraulic fluid from the other of the advancing hydraulic chambers and retarding hydraulic chambers and thereby the vane rotor is rotated relative to the housing.

The publication further describes a locking mechanism for fixing a vane rotor to the housing member. The locking member comprising a locking pin, a spring, and an engaging bore. The locking pin is movably accommodated in a hole provided on the vane. The locking pin has a leading portion provided at one end of the locking pin and a hollow space provided inside of the locking pin. The hollow space has an opening which opens in an opposite direction to the leading head and accommodates the spring. One end of the spring is supported at the bottom surface of the hollow space and the other end is supported at the bottom surface of the hole. Thereby the spring urges the locking pin so that the leading head protrudes from the hole. The engaging bore is provided on the housing member to accommodate the leading head at the most retarding position of the vane rotor with respect to the housing member.

When the engine is out of operation, or when the hydraulic pressure in the retarding hydraulic chambers is under a predetermined value, the vane rotor is at the most retarded position with respect to the housing member and the leading head is urged into an engaging bore by the spring. As a result, an impinging sound that otherwise would be caused by the relative movement of the vanes and the housing member is prevented from being generated even if the camshaft undergoes positive or negative torque variation in driving the intake valves or exhaust valves. When the pressure generated by supplying the hydraulic fluid in the advancing chambers or the retarding chambers becomes over the predetermined value, the leading head of the locking pin is retracted from the engaging bore resisting the spring force and the vane rotor relatively rotates with respect to the housing member.

However, since the spring is accommodated in the hollow space without any support that prevents the spring from buckling, the spring can be buckled undesirably by the movement of the locking pin when the locking pin moves in response to the hydraulic pressure. This causes a clogging of the locking pin in the hole, thus permitting an impinging between the vane and housing member, along with the generation of an undesirable noise.

SUMMARY OF THE INVENTION

Accordingly, in view of above-described problems encountered in the related art, a principal object of the present invention is to provide a vane-type VTC that prevents a clogging of the locking pin.

Another object of the present invention is to provide a locking mechanism which is rapidly and reliably movable.

Still another object of the present invention is to provide a vane-type VTC which has an easily assembled locking mechanism.

In order to achieve these and other objects, there is provided a variable valve timing control apparatus for an internal combustion engine, having a first shaft and a second shaft, that comprises a housing member rotated in synchronism with one of the first shaft or the second shaft. The housing has a circular space provided in the housing and at least one fan-shaped space radially extending from an outer circumferential surface of the circular space, a vane rotor rotated in synchronism with the other of the first shaft or the second shaft and accommodated in the housing member in order to relatively rotate with respect to the housing member. The vane rotor has at least one vane radially extending so as to divide each the at least one fan-shaped space into a first chamber and a second chamber. A hole is provided in one of the housing member and the vane, an engaging bore is provided in the other of the housing member and the vane, and a locking mechanism is provided in the hole for fixing the rotational phase between the housing member and the vane rotor that comprises a locking member having a leading head portion provided at the one end of the locking member and a hollow space portion. The hollow space portion has an opening which opens in an opposite direction to that of the leading head portion, a stopper member having a first portion and a second portion, the first portion and the second portion having a different diameter so that a diameter of the second portion is smaller than a diameter of the first portion, the second portion protruding from a side face of the first portion in order that the second portion is accommodated in the hollow space portion. A coil spring is provided between the locking member and the stopper member so as to surround the second portion, the coil spring urging the locking member toward the engaging bore in order that the leading head portion is accommodated in the engaging bore, the locking member being movable in response to hydraulic pressure in the first hydraulic chamber or the second hydraulic chamber in order that the leading head portion is retracted from the engaging bore.

Other aspects and advantages of the invention will become apparent from the following description, taken in conjunction with the accompanying drawings, illustrating by way of example the principles of the invention.

DETAILED DESCRIPTION OF THE PREFERRED EMBODIMENT

A variable valve timing apparatus (vane-type VTC) according to a preferred embodiment of the present invention will now be described with reference to the drawings. According to the preferred embodiment of the present invention, a vane-type VTC is provided on an intake camshaft, but easily can be provided on an exhaust camshaft.

Figure 1:
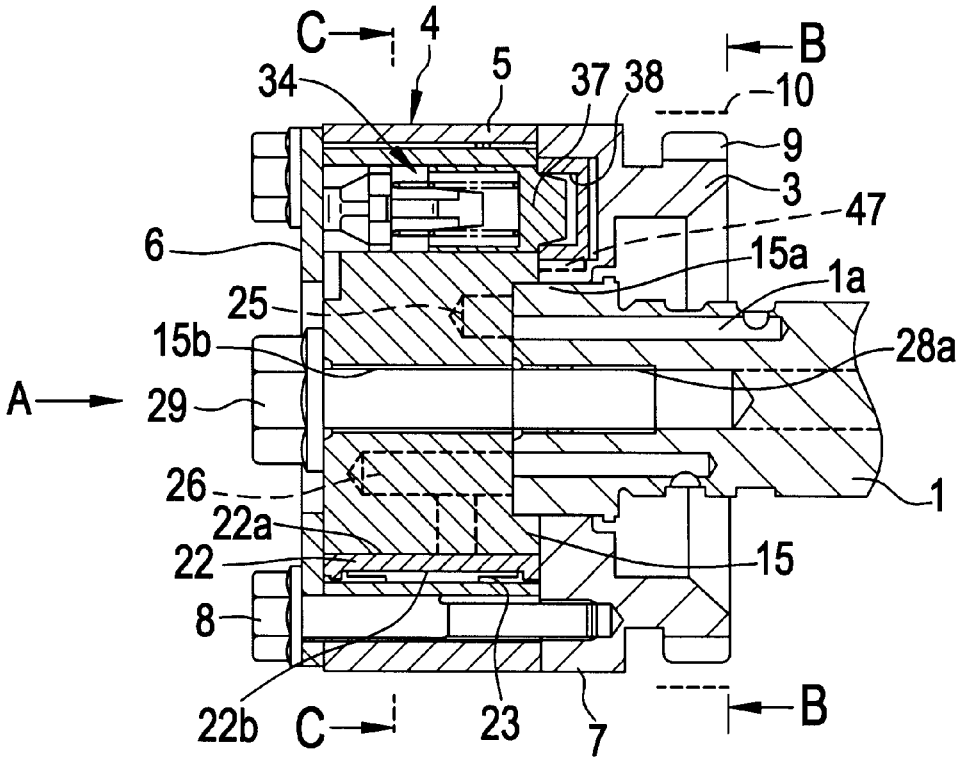
FIG. 1 is vertical sectional drawing, showing a variable valve timing control apparatus according to an embodiment of the present invention.
Figure 2:
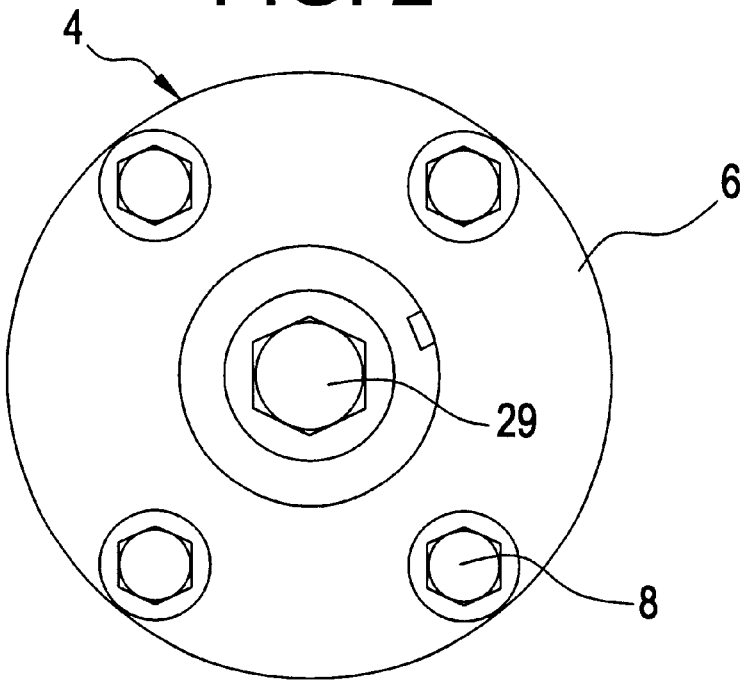
FIG. 2 is a side view taken from arrow A of FIG. 1.
Figure 3:
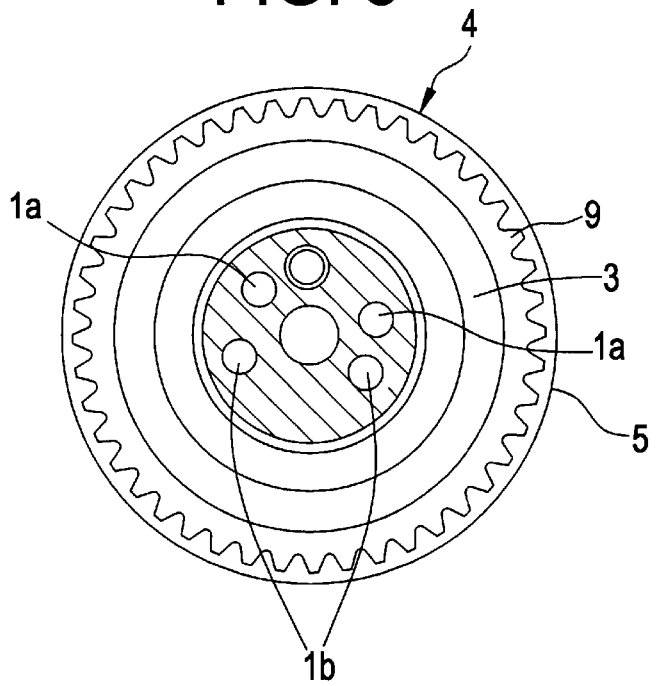
FIG. 3 is a sectional view taken on line B—B of FIG. 1.

As shown in FIGS. 1, 2 and 3, a camshaft 1 operates an intake valve (not shown) of an internal combustion engine. The camshaft 1 is supported by a bearing (not shown) fixed on a cylinder head (not shown) of the engine and operates a cam provided on the camshaft (not shown). The camshaft 1 operates the intake valve. The camshaft 1 is rotated by a chain sprocket 3 which is rotated in synchronism with a crank shaft (not shown) of the engine.

A housing member relatively rotates with respect to the camshaft 1. The housing member 4 comprises a main body 5 formed with a cylindrical shape and plate members 6 and 7, which close the two axial sides of the main body 5. The sprocket 3, the main body 5 and plate members 6 and 7 are fixed together by bolt 8.

Gear teeth 9 are provided on an outer circumferential surface of the sprocket 3. A timing chain 10 connects the crank shaft with the sprocket 3 to transmit the engine revolution from the crank shaft to the camshaft 1.

Figure 4:
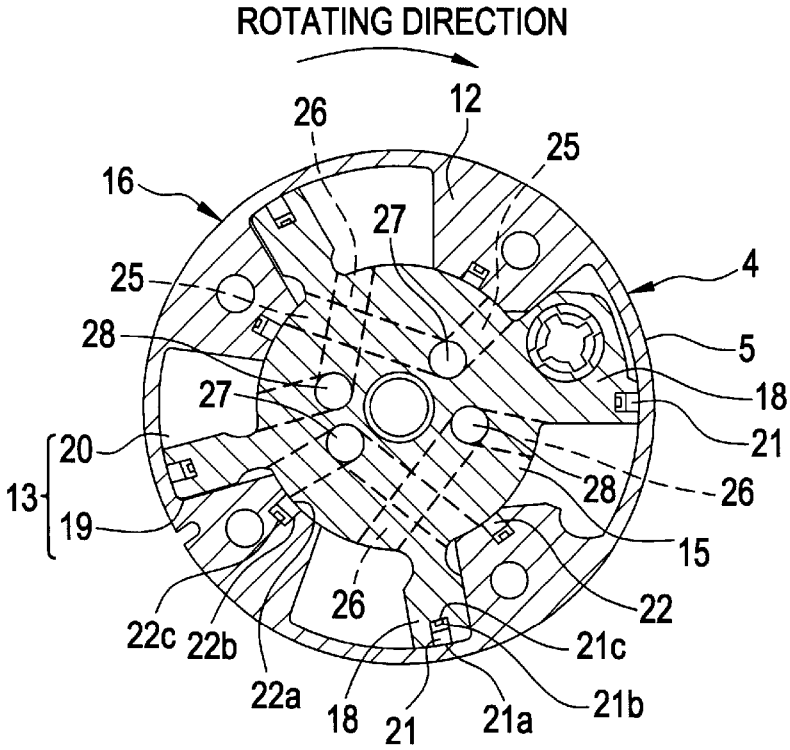
FIG. 4 is a sectional view taken on line C—C of FIG. 1.

As shown in FIG. 4, a circular space and plural shoes 12 are formed inside of the housing member 4. Each shoe 12 is protruding from the inner circumferential surface of the housing member 4, in order that a fan-shaped hydraulic chamber 13 is defined between the shoes 12. The fan-shaped hydraulic chambers 13 are connect to the circular space which is filled by a vane rotor 15. According to the first embodiment of the present invention, four shoes 12 and four fan-shaped hydraulic chambers 13 are provided. The vane rotor 15 is provided in the housing member 4 and has plural vanes 18 protruding from outer circumferential surface of the vane rotor 15. The vane rotor 15 is accommodated in the housing member 4 in order that each vane 18 is located in each fan-shaped hydraulic chamber 13 and that the vane rotor relatively rotates with respect to the housing member 4 within a range of predetermined angle.

Each vane 18 defines, in the corresponding the fan-shaped hydraulic chambers 13, an advancing hydraulic chamber 19 and a retarding hydraulic chamber 20. The advancing hydraulic chamber 19 is provided on the trailing side with respect to the rotating direction of the vane 18, while the retarding hydraulic chamber 20 is provided on the leading side.

As shown in FIG. 4, a seal member 21 is provided on the outer circumferential surface of each vane 18. Each seal member 21 has a sealing face 21*a* and a concave portion 21*b*. A spring 21*c*, formed in an arc shape, is provided in the concave portion 21*b* for urging the seal member toward the inner circumferential surface of the fan-shaped hydraulic chamber 13. The spring 21*c* is prohibited from relatively moving with respect to the seal member 21 in an axial direction of the vane rotor 15.

As shown in FIGS. 1 and 4, a seal member 22 is provided on the inner circumferential surface of each shoe 12. Each seal member 22 has a sealing face 22*a* and a concave portion 22*b*. A spring 22*c*, formed in an arc shape, is provided in the concave portion 22*b* for urging the seal member toward the outer circumferential surface of the vane rotor 15. The spring 22*c* is prohibited from relatively moving with respect to the seal member 22 in an axial direction of the vane rotor 15.

Each sealing member 21 and 22 is made from metal, or elastic material, for example, synthetic resin, by molding, and is formed in an arc shape which has a large radius of curvature in an axial direction of the vane rotor 15. Each sealing surface 21*a* and 22*a* is formed in an arc shape toward the inner circumferential surface of the hydraulic chamber 13 and outer circumferential surface of the vane rotor 15, respectively.

Each spring 21*c* and 22*c* is made from metal, or elastic material, for example, synthetic resin. Thus, in the case where the springs 21*c* and 22*c* are made of the same material as the sealing members 21 and 22, the springs 21*c* and 22*c* can be formed integrally with the sealing members 21 and 22, respectively.

Therefore, each sealing member 21 and 22 prohibits the transference of hydraulic fluid between the advancing hydraulic chamber 19 and the retarding hydraulic chamber 20.

Next, hydraulic passages for supplying, or discharging, the hydraulic fluid to, or from, the advancing hydraulic chambers 19 and the retarding hydraulic chambers 20 will be described.

As shown in FIGS. 1, 3 and 4, according to the first embodiment of the present invention, four first passages 25 and four second passages 26 are provided in the vane rotor 15 in a radial direction of the vane rotor 15. Two third passages 27 and two fourth passages 28 are provided in the vane rotor 15 in an axial direction. Two fifth passages 1*a* and two sixth passages 1*b* are provided in the camshaft 1.

Each first passage 25 has an opening which opens in each advancing hydraulic chamber 19. One end of each third passage 27 is connected to every two first passages 25. The other end of each third passage 27 is connected to each fifth passage 1*a* at which the housing member 4 and the camshaft 1 are connected together. Therefore, two fifth passages 1*a* are provided in the camshaft 1.

Each second passage 26 has an opening which opens in each retarding hydraulic chamber 20. One end of each forth passage 28 is connected to every two second passages 26. The other end of each forth passage 28 is connected to each sixth passage 1*b* at which the housing member 4 and the camshaft 1 are connected together. Therefore, two sixth passages 1*b* are provided in the camshaft 1.

The other end of the fifth passages 1*a* and sixth passages 1*b* are connected to the hydraulic source (not shown) and drain port (not shown) via the other passages (not shown) provided in the engine (not shown) and a control valve (not shown). The control valve is operated by a controller (not shown), based on the engine condition, and selectively connects the hydraulic source to the fifth passages 1*a* or the sixth passages 1*b*. Thus, when either the fifth passages 1*a* or the sixth passages 1*b* are connected to the hydraulic source, the other of fifth passages 1*a* and sixth passages 1*b* are connected to the drain port by the control valve. Thereby the hydraulic fluid is selectively supplied to, or discharged from, the advancing hydraulic chambers 19, or retarding hydraulic chambers 20.

As shown in FIG. 1, a concave portion 15*a* is provided on the side face of the vane rotor 15 for receiving an end face of the camshaft 1. The camshaft 1 is penetrating the plate member 7 and an end face of the camshaft 1 is connected to the vane rotor 15 at the concave portion 15*a* by a bolt 29 inserted into a hole 15*b*, which is formed at the center of the vane rotor 15.

In short, since the sprocket 3 is connecting to the housing member 4 and the camshaft 1 is connecting to the vane rotor 15, the vane rotor 15 relatively rotates with respect to the housing member 4 by regulating hydraulic pressure in the advancing hydraulic chambers 19 and retarding hydraulic chambers 20 operated by the hydraulic source. Therefore the camshaft 1 relatively rotates with respect to the sprocket 3 within a range of predetermined angles.

Figure 5:
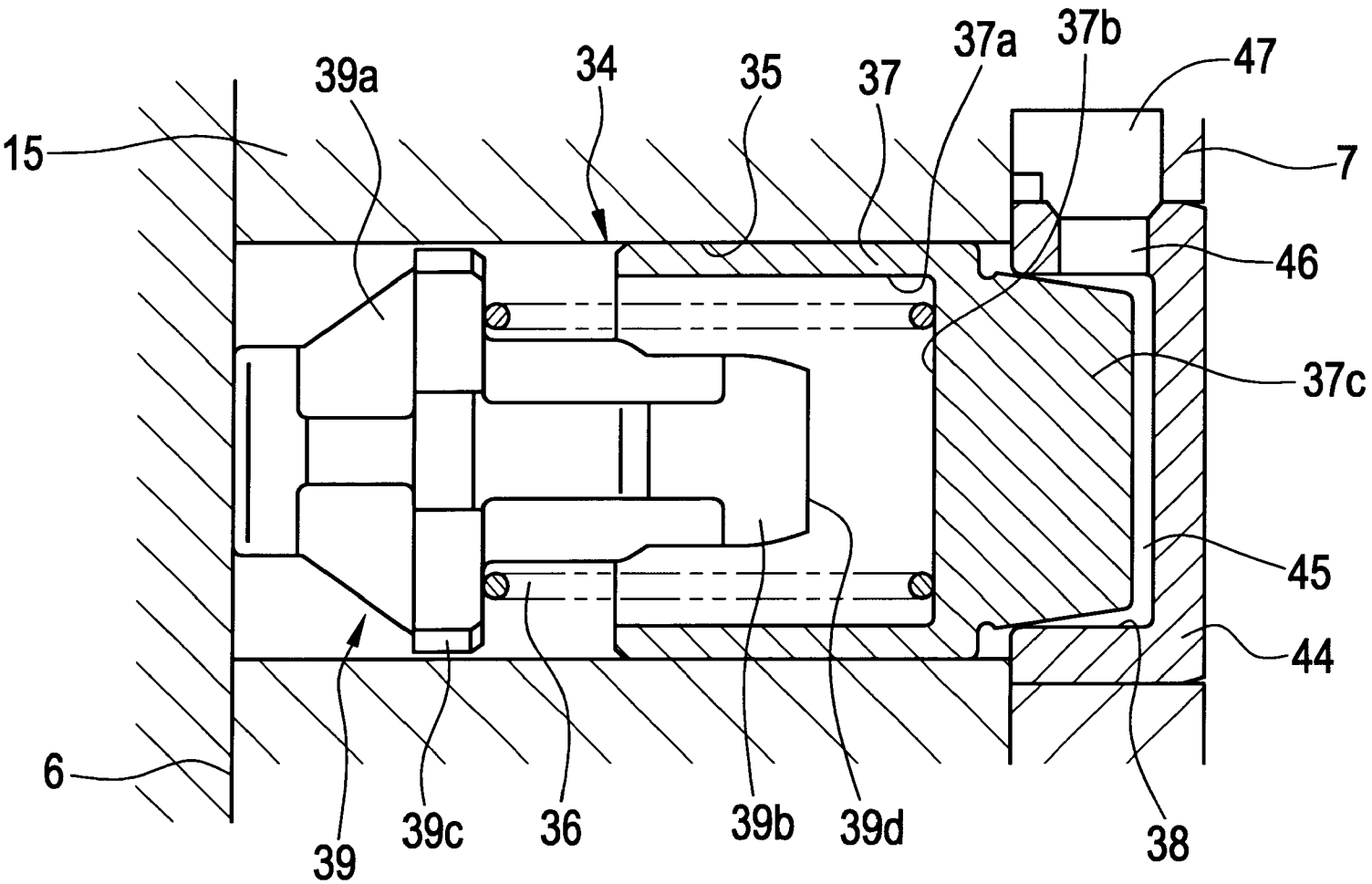
FIG. 5 is an enlarged sectional drawing, showing a locking mechanism wherein a locking member is accommodated in an engaging bore.

Next, a locking mechanism 34 for fixing the vane rotor 15 to the housing member 4 will be described. As shown in FIGS. 1, 4 and 5, the locking mechanism 34 is accommodated in a hole 35 provided on the vane 18 whose width in a circumferential direction is wider than the other vanes 18 in the axial direction of the vane rotor 15. The locking mechanism 34 comprises a locking pin 37, a stopper member 39 and a coil spring 36. The locking pin 37 has a leading head portion 37*c* provided at one end of the locking pin 37 in an axial direction of the locking pin 37 and a hollow space portion 37*a* which opens in an opposite direction to that of the leading head portion 37*c*. The hollow space portion 37*a* accommodates one end of the coil spring 36 and supports the one end of the coil spring 36 at the bottom surface 37*b*. The other end of the coil spring 36 is supported by the stopper member 39. Therefore, the hole 35 accommodates, according to the direction from the plate member 6 to the plate member 7, the stopper member 39, the coil spring 36 and the locking pin 37. The coil spring 36 urges the locking pin 37 toward the plate member 7 in order that the leading head portion 37*c* protrudes from the hole 35.

As shown in FIGS. 1 and 5, an engaging bore 38 is provided on the plate member 7 in order to accommodate the leading head portion 37*c* when the leading head portion 37*c* is protruded from the hole 35 by urging force of the coil spring 36. Thus, since the locking pin 37 is provided in the vane 18 and the engaging bore 38 is provided on the plate member 7, which is a part of the housing member 4, the relative rotation between the vane rotor 15 and the housing member 4 is prohibited when the leading head portion 37*c* of the locking pin 37 is accommodated in the engaging bore 38.

As shown in FIG. 5, the stopper member 39 has, according to the direction from the plate member 6 to the plate member 7, a tapered portion 39*a*, a cylindrical portion 39*e* and a stopper portion 39*b*.

The tapered portion 39*a* is protruding from the cylindrical portion 39*e* toward the plate member 6 and is formed in order that the diameter of the tapered portion decreases toward the plate member 6. An end face of the tapered portion 39*a* touches the plate member 6. Thus, the plate member 6 supports the stopper member 39 urged by counterforce of the spring 36. The cylindrical portion 39*e* has plural notches 39*c* on its outer circumferential surface. The notches 39*c* permit air flow between the hollow space portion 37*a* and a space defined by the tapered portion 39*a*, the hole 35 and the plate member 6. The stopper portion 39*b* is protruding from the cylindrical portion 39*e* toward the plate member 7 and is provided in order to have a tapered portion at the head of the stopper portion 39*b*.

Figure 6:
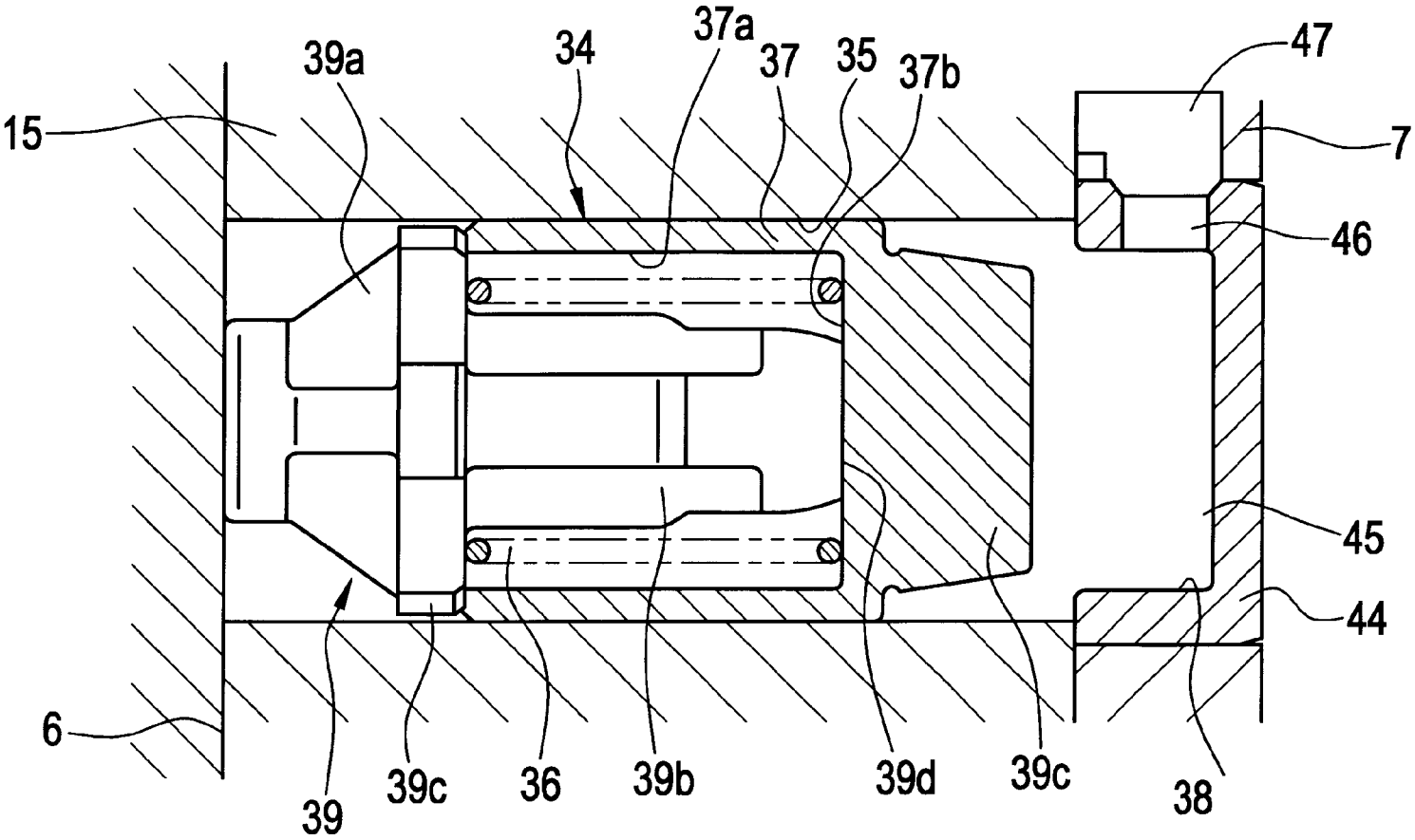
FIG. 6 is an enlarged sectional drawing, showing a locking mechanism of the first embodiment of the present invention wherein a locking member is accommodated in an engaging bore.
Figure 7:
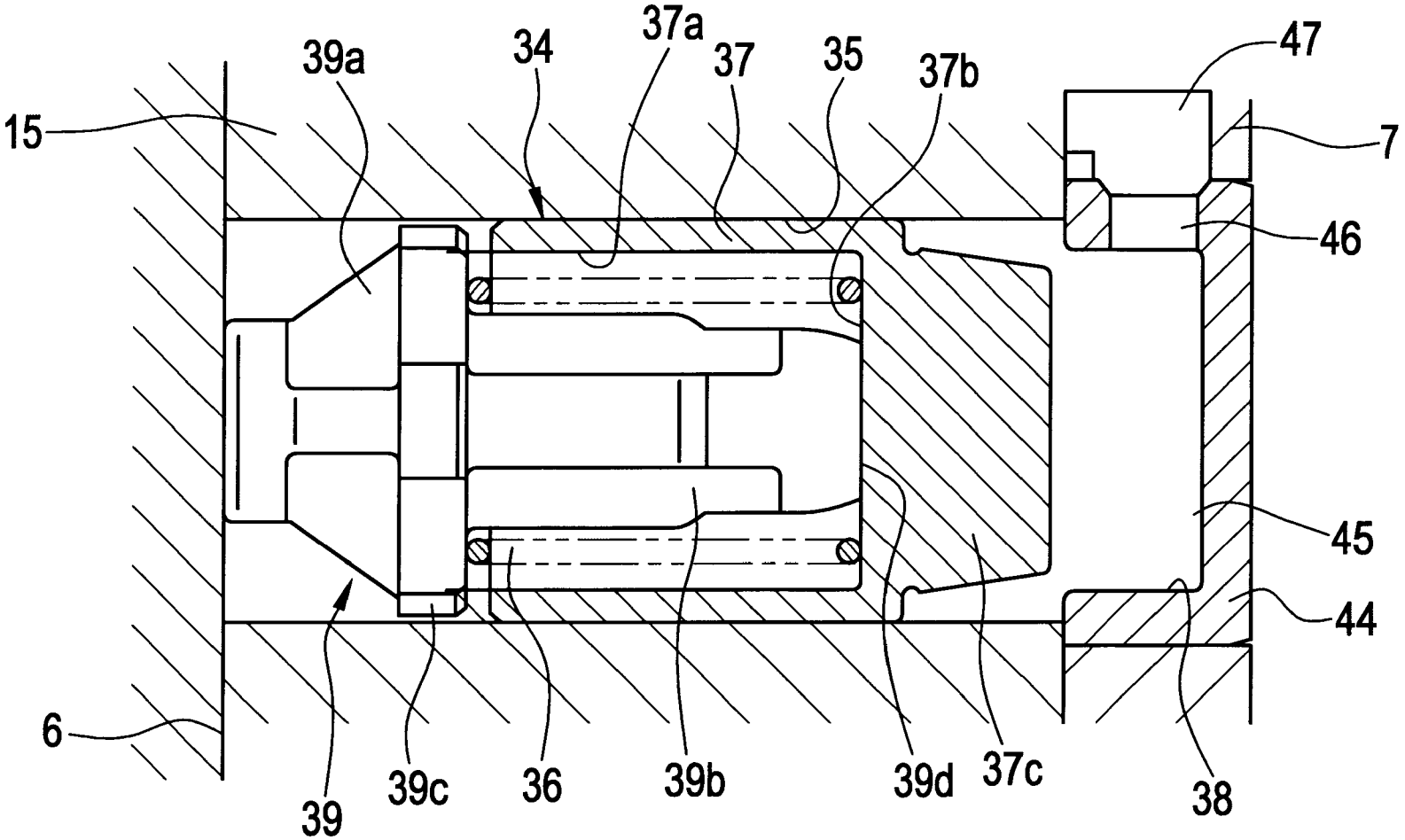
FIG. 7 is an enlarged sectional drawing, showing a locking mechanism of the second embodiment of the present invention wherein a locking member is accommodated in an engaging bore.

As shown in FIG. 6, the height of the stopper portion 39*b* in its axial direction is provided so that the height and the depth of the hollow space portion 37*a* correspond appropriately, and are substantially identical. In other words, when the bottom surface 37*b* of the hollow space portion 37*a* touches an end face 39*d* of the stopper portion 39*b*, an opening surface of the hollow space portion 37*a* also touches a side face of the cylindrical portion 39*e*. Thus, the stopper portion 39*b* and the side face of the cylindrical portion 39*e* restrict the movement of the locking pin 37 toward the plate member 6 when the leading head portion 37*c* is retracted from the engaging bore 38. An alternative embodiment, as shown in FIG. 7, will be explained subsequently.

As mentioned before, the hollow space portion 37*a* accommodates the coil spring 36 and supports the one end of the spring 36 at the bottom surface 37*b*. The other end of the coil spring 36 is supported at the side face of the cylindrical portion 39*e* and accommodates the stopper portion 39*b*. Therefore, the coil spring 36 is surrounded by the hollow space portion 37*a*, while the coil spring 36 surrounds the stopper portion 39*b*. Thereby, the stopper portion 39*b* prevents the coil spring 36 from buckling when the coil spring 36 is compressed. The stopper member 39, which is urged toward the plate member 6, is made from synthetic resin in order to decrease the friction which occurs when the vane rotor 15 rotates relatively with respect to the housing member 4.

The leading head portion 37*c* is provided with a tapered surface whose diameter decreases toward an end face of the leading head portion 37*c*. The engaging member 44 is made from high-strength steel which has abrasion resistance, for example, surface-hardened alloy or quenched chromium-molybdenum steel, and is embedded in the plate member 7.

The leading head portion 37*c* and the engaging member 44 cooperatively define a hydraulic chamber 45 when the leading head portion 37*c* is accommodated in the engaging bore 38. The hydraulic chamber 45 is connected to one of the advancing hydraulic chambers 19 by passages 46 and 47 provided on the engaging bore 44 and plate member 7, respectively.

As shown in FIG. 4, when the engine is out of operation or just after it has started to run, that is when the pressure in both of the advancing hydraulic chambers 19 and retarding hydraulic chambers 20 are low, or when the controller outputs, based on the engine condition, a control signal to keep the vane rotor 15 at the most retarded position with respect to the housing member 4, the vane rotor 15 is at the most retarded position with respect to the housing member 4. At this point, as shown in FIGS. 1 and 5, the leading head portion 37*c* is accommodated in the engaging bore 38 and fixes the vane rotor 15 to the housing member 4.

Thereby, a driving force is transmitted from the crankshaft to the sprocket 3 via the timing chain 10, the housing member 4, the locking pin 37, and vane rotor 15, and thus the camshaft 1 operates the intake valve.

Next, an advancing operation controlled by the controller will be described. When the leading head portion 37*c* is accommodated in the engaging bore 38 by the urging force of the spring 36, the locking pin 37 prevents the vane rotor 15 from relatively rotating with respect to the housing member 4, even if the camshaft 1, which is connected to the vane rotor 15, undergoes positive or negative torque variation in driving the intake valves or exhaust valves. Consequently, the generation of an impinging sound, which would be caused by an impingement between the vanes 18 and the shoes 12, is prevented.

When the controller outputs a control signal in order that the vane rotor 15 rotates relatively in an advancing direction with respect to the housing member 4, the controller operates the control valve in order to supply the hydraulic fluid to the advancing hydraulic chambers 19. At this point, the hydraulic fluid supplied to the advancing hydraulic chambers 19 is also supplied to the hydraulic chamber 45 via the passages 46 and 47. As shown in FIG. 6, the hydraulic pressure generated by the hydraulic fluid, which is supplied to the hydraulic chamber 45, urges the locking pin 37 to retract from the engaging bore 44 until the bottom surface 37*b* touches the end face of the stopper portion 39*b* resisting the spring force of the spring 36. Thereby, the fixed relationship between the vane rotor 15 and the housing member 4 is released and the vane rotor 15 is able to rotate relatively with respect to the housing member 4. At this point, the locking pin 37 is pushed to a position where the bottom surface 37*b* touches the end face 39*d* by the hydraulic pressure. In other words, the movement of the locking pin 37 toward the plate member 6 is prohibited by the stopper portion 39*b* in order to prevent the locking pin 37 from moving an extreme distance when the leading head portion 37*c* is retracted from the engaging bore 38 by the hydraulic pressure. Further, the stopper portion 39*b*, which is surrounded by the coil spring 36, prevents the coil spring 36 from buckling.

During the advancing operation, the hydraulic fluid is supplied to the advancing hydraulic chambers 19 and is discharged from the retarding hydraulic chambers 20. Thereby the hydraulic fluid in the advancing hydraulic chambers 19 provides a force on the vane 18 that causes the vane rotor 15 to rotate relatively in a clockwise direction with respect to the housing member 4. Therefore, the rotational phase of the camshaft with respect to the crankshaft is changed, and the valve timing of the intake valve is changed.

Figure 8:
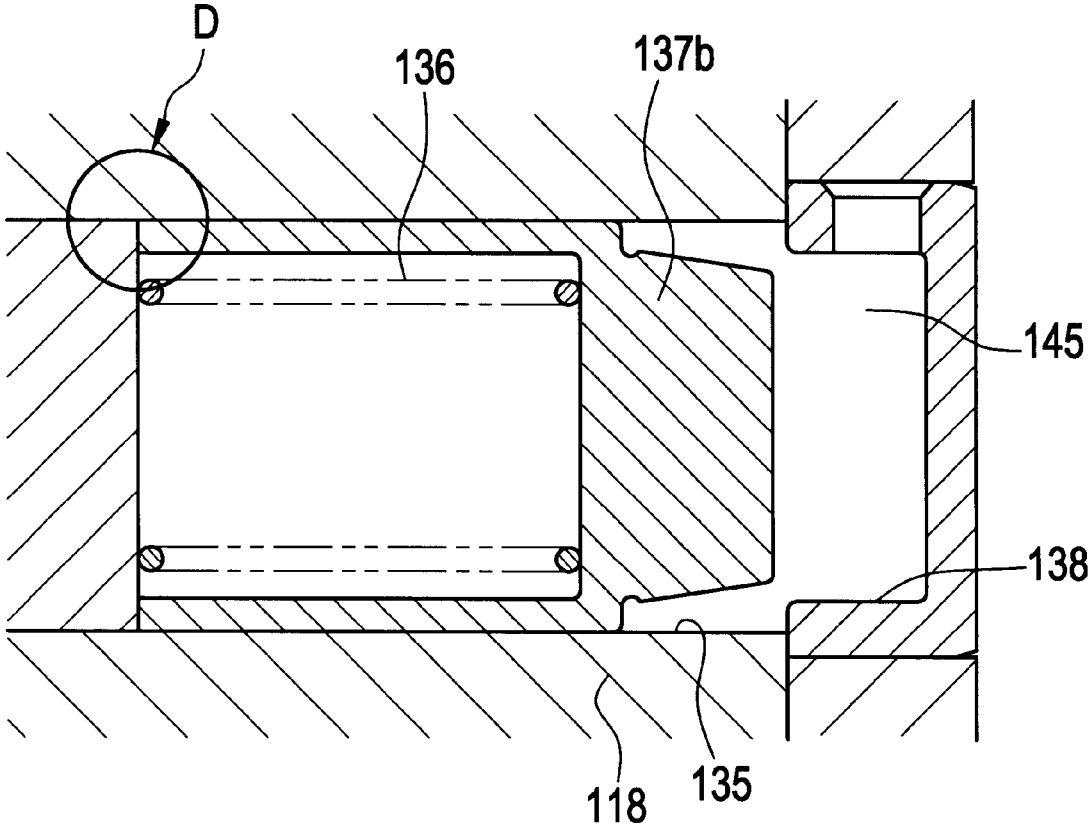
FIG. 8 PRIOR ART
FIG. 8 is an enlarged sectional drawing, showing a locking member of the related art.
Figure 9:
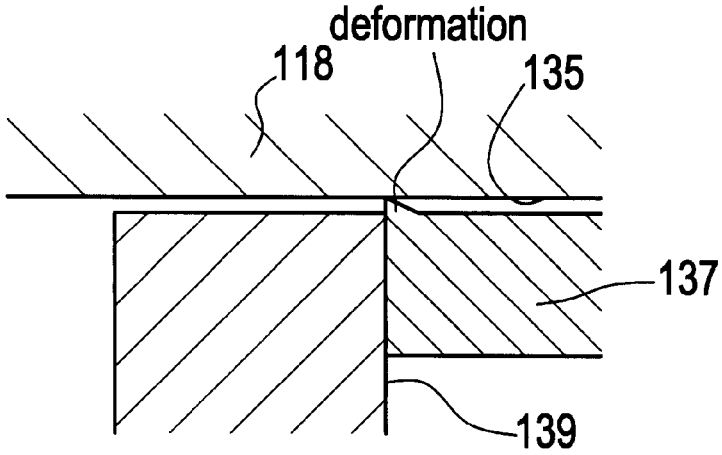
FIG. 9 PRIOR ART
FIG. 9 is an enlarged sectional drawing taken on circle D of FIG. 8.

As shown in FIGS. 8 and 9, which disclose a related art, a locking pin 137 touches a stopper member 139 at the end face of the locking pin 137. In other words, impinging shock which is generated by an impingement between the locking pin 137 and the stopper member 139, when the locking pin 137 moves in response to the hydraulic pressure affects the end face of the locking pin 137. However, since a coil spring 136 is provided in the locking pin 137, it is difficult to provide a large touching area to the end face of the locking pin 137. Therefore, the impinging force per square inch is large. Thereby deformation 150, which would be cause clogging of the locking pin 137 in a hole 135, is made at the end face of the locking pin 137.

As mentioned previously, when the leading head portion 37*c* is retracting from the engaging bore 38, the end face 39*d* is touching the bottom surface 37*b*, while an opening surface of the hollow space portion 37*a* is also touching a side face of the cylindrical portion 39*e*. Thus, both the end face 39*d* and side face of the cylindrical portion 39*e* receive the impinging force between the locking pin 37 and the stopper member 39, which occurs when the locking pin 37 is moved by the hydraulic pressure dispersing the force. The diameter of the stopper portion 39*b* is provided so that a gap defined between inner surface of the hollow space portion 37*a* and outer surface of the stopper portion 39*b* at the end face 39*d* is larger than the gap at the root portion where the stopper portion 39*b* protrudes from the side face of the cylindrical portion 39*e* in order to provide the smooth compression of the coil spring 36. Thereby, the coil spring 36 is prevented from nipping between the locking pin 37 and the stopper portion 39*b*.

Next, a retarding operation controlled by the controller will be described. When the controller outputs, based on the engine condition, a control signal in order that the vane rotor 15 rotates relatively in a retarding direction with respect to the housing member 4, the hydraulic fluid is supplied to the retarding hydraulic chambers 20 via the passages 1*b*, 28 and 26 and is discharged from the advancing hydraulic chambers 19 via the passages 1*a*, 27 and 25. At this point, since the leading head portion 37*c* is accommodated in the engaging bore 38 at the most retarded position of the vane rotor 15 with respect to the housing member 4, the vane rotor 15 is able to rotate relatively with respect to the housing member 4.

While the hydraulic fluid is supplied to the retarding hydraulic chambers 20, the hydraulic fluid is discharged from the advancing hydraulic chambers 19. Thereby the hydraulic fluid in the retarding hydraulic chambers 20 provides a force on the vane 18 that causes the vane rotor 15 to rotate relatively with respect to the housing member 4 in a counterclockwise direction. Therefore, the rotational phase of the camshaft 1 with respect to the crankshaft is changed, and thus the valve timing of the intake valve is changed. When the vane rotor 15 is positioned at the most retarded position with respect to the housing member 4 by the retarding operation, the locking pin 37 is accommodated in the engaging bore 37 by the spring force of the coil spring 36.

Next, an intermediate operation controlled by the controller will be described. When the controller outputs, based on the engine condition, a control signal in order that the vane rotor 15 is at intermediate position between the most retarded position and the most advanced position with respect to the housing member 4, the control valve disconnects the passages 1*a* and 1*b* to the hydraulic source and drain port and, thereby, the pressure in all of the advancing chambers 19 and retarding chambers 20 is retained. Therefore, the vane rotor 15 is positioned at the intermediate position between the most advanced position and the most retarded position with respect to the housing member 4. As a result, the intake valve is operated, based on the engine condition, at the preferable timing by the camshaft 1.

During the intermediate operation, the coil spring urges the locking pin 37 toward the plate member 7. However, since the leading head portion 37*c* is accommodated in the engaging bore 38 at the most retarded position of the vane rotor 15 with respect to the housing member 4, the vane rotor 15 is able to rotate relatively with respect to the housing member 4.

As detailed above, the movement of the locking pin 37 is restricted by the stopper member 39 when the leading head portion 37*c* of the locking pin 36 is retracted from the engaging bore, and the inside of the coil spring 36 is supported by the stopper portion 39*b*. In other words, since the coil spring 36 is supported by the stopper portion 39*b* in order to support inside of the coil spring 36, an undesirable buckling of the coil spring 36 is prohibited. Thereby, a clogging of the locking pin 37 in the hole 35 caused by the buckling is prevented. Yet, since the stroke amount of the locking pin 37 is limited by the stopper portion 39*b*, an unnecessary compression of the coil spring 36 is prohibited. Further, since the diameter of the stopper portion 39*b* is provided so that the gap defined between inner surface of the hollow space 37*a* and outer surface of the stopper portion 39*b* at the end face 39*d* is larger than the gap at the root portion of the stopper portion 39*b*, the coil spring 36 is smoothly compressed, and thus a nipping of the coil spring 36, which would be cause the clogging of the locking pin 37 between the locking pin 37 and stopper portion 39*b*, is prevented. Moreover, since both the end face 39*d* and side face of the cylindrical portion 39*e* touch the bottom surface 39*d* and an opening surface of the hollow space 37*a*, respectively, when the locking pin 37 is moved toward the plate member 6, the touching area between the stopper member 39 and locking pin 37 is set to be large and, thus, the impingement force square per inch is decreased. Since deformation at the end face of the locking pin 37, due to touches of the side surface of the stopper portion 39*c*, is avoided, the clogging of the locking pin 37 in the hole 35 is prevented.

Next, the vane-type VTC according to a second embodiment of the present invention will be described, referring FIG. 7. Parts of this embodiment are given the same reference characters to corresponding parts of the first embodiment, and only differences from the first embodiment will be described.

In this embodiment, as shown in FIG. 7, the length L1 of the stopper portion 39*b* in an axial direction is made longer than the depth L2 of the hollow space portion 37*a*. Thereby the stopper member 39 touches the locking pin 37 at only the end face 39*d*. However, since the stopper member 39 is made from synthetic resin, and since the impinging force square per inch which affects the end face 39*d* is large, repeated impinging deforms the stopper portion 39*b* so that the length of the stopper portion 39*b* corresponds to the depth of the hollow space portion 37*a*. After the length of the stopper portion 39*b* and the depth of the hollow space portion 37*a* become equal over time, both the end face 39*d* and side face of the cylindrical portion 39*e* receive the impinging force dispersing to the both surfaces. Consequently, additional deformation of the stopper portion 39*b* is prevented. According to the second embodiment of the present invention, there is no need to precisely provide a length of the stopper portion 39*b* so that it corresponds to the depth of the hollow space portion 37*a*. Therefore, a vane type VTC which has an easily operable locking mechanism 34 can be provided.

The present embodiments are to be considered as illustrative and not restrictive and the invention is not to be limited to the details given herein, but may be modified.

For example, while the embodiment of the invention shows that the intake camshaft 1 is subject to the variable valve timing control apparatus, an exhaust camshaft may also be controlled. In this case, the locking mechanism is provided at the most advancing position of the vane rotor 15 with respect to the housing member 4.

Another example, while the embodiment of the invention shows that the locking pin 37 and the engaging bore 38 are provided in the vane 18 and housing member 4 respectively, the locking pin 37 and the engaging bore 38 may also be provided in the housing member 4 and vane 18 respectively.

Further example, while the embodiment of the invention shows that the locking pin 37 is provided in the vane 18, the locking pin 37 may also be provided in the vane rotor 15.

While the present invention is disclosed on the basis of certain preferred embodiments, it is not limited thereto, but is defined by the appended claims as interpreted in accordance with applicable law.

This application relates to and incorporates herein by reference Japanese Patent application No. 2000-187460 filed on Jun. 22, 2000, from which priority is claimed.

What is claimed is:

1. A variable valve timing control apparatus for an internal combustion engine, comprising:

a housing member rotated in synchronism with one of a first shaft and a second shaft, said housing member comprising a circular space provided in said housing member and at least one fan-shaped space radially extending from an outer circumferential surface of said circular space;

a vane rotor rotated in synchronism with the other of said first shaft and said second shaft and accommodated in said housing member in order to relatively rotate with respect to said housing member, said vane rotor comprising radially extending at least one vane so as to divide each said at least one fan-shaped space into first chamber and second chamber;

a hole provided in one of said housing member and said vane;

an engaging bore provided in the other of said housing member and said vane; and a locking mechanism provided in said hole for fixing the rotational phrase between said housing member and said vane rotor, said locking mechanism defining an axial direction of movement and comprising:

a locking member comprising a leading head portion and a hollow space portion disposed along said axial direction, said hollow space portion comprising an opening which opens in an opposite direction to said leading head along said axial direction;

a stopper member comprising first portion and second portion disposed in said axial direction, said first portion and said second portion comprising a different diameter along said axial direction so that a diameter of said second portion is smaller than a diameter of said first portion, said second portion protruding from a side face of said first portion in order that said second portion is accommodated in said hollow space; and a coil spring provided in said axial direction between said locking member and said stopper member so as to surround said second portion, said coil spring urging said locking member in said axial direction toward said engaging bore in order that said leading head is accommodated in said engaging bore.

2. The apparatus according to claim 1, wherein an end face of said second portion restricts the movement of said locking member in said axial direction by touching to a bottom surface of said hollow space when said locking pin is moved toward said stopper member.

3. The apparatus according to claim 2, wherein a height of said second portion is provided in said axial direction so that said height is the same as a depth of said hollow space in said axial direction.

4. The apparatus according to claim 2, wherein a height of said second portion is provided in said axial direction so that said height is longer than a depth of said hollow space in said axial direction.

5. The apparatus according to claim 1, wherein said second portion has a plurality of different diameters in said axial direction in order that a diameter at said end face is smaller than a diameter at a root portion where said second portion is protruding from said first portion.

6. The apparatus according to claim 3, wherein said second portion has a plurality of different diameters in said axial direction in order that a diameter at said end face is smaller than a diameter at a root portion where said second portion is protruding from said first portion.

7. The apparatus according to claim 4, wherein said second portion has a plurality of different diameters in said axial direction in order that a diameter at said end face is smaller than a diameter at a root portion where said second portion is protruding from said first portion.

8. The apparatus according to clam 5, wherein said second portion is provided with tapered surface.

9. The apparatus according to clam 6, wherein said second portion is provided with tapered surface.

10. The apparatus according to clam 7, wherein said second portion is provided with tapered surface.

11. The apparatus according to claim 8, wherein said stopper member is made from synthetic resin.

12. The apparatus according to claim 9, wherein said stopper member is made from synthetic resin.

13. The apparatus according to claim 10, wherein said stopper member is made from synthetic resin.

14. The apparatus according to claim 11, wherein said second portion is integrally formed with said first portion.

15. The apparatus according to claim 12, wherein said second portion is integrally formed with said first portion.

16. The apparatus according to claim 13, wherein said second portion is integrally formed with said first portion.

17. A variable valve timing control apparatus for an internal combustion engine, comprising:

an intake camshaft for operating an intake valve;

a housing member rotated in synchronism with a crankshaft, said housing member comprising a circular space provided inside of said housing member and at least one fan-shaped space radially extending from an outer circumferential surface of said circular space;

a vane rotor rotated in synchronism with said intake camshaft and accommodated in said housing member in order to relatively rotate with respect to said housing member, said vane rotor comprising radially extending at least one vane so as to divide each said at least one fan-shaped space into first chamber and second chamber;

a hole provided in said vane;

an engaging member provided in said housing member; and a locking mechanism provided in said hole for fixing the rotational phrase between said housing member and said vane rotor, said locking mechanism defining an axial direction of movement and comprising:

a locking member comprising a leading head portion and a hollow space portion disposed along said axial direction, said hollow space portion comprising an opening which opens in an opposite direction to said leading head along said axial direction;

a stopper member comprising first portion and second portion disposed in said axial direction, said second portion being formed integrally with said first portion, said first portion and said second portion comprising a different diameter along said axial direction so that a diameter of said second portion is smaller than a diameter of said first portion, said second portion protruding from a side face of said first portion in order that said second portion is accommodated in said hollow space;

a coil spring provided in said axial direction between said locking member and said stopper member so as to surround said second portion, said coil spring urging said locking member in said axial direction toward said engaging bore in order that said leading head is accommodated in said engaging bore.

18. The apparatus according to claim 17, wherein an end face of said second portion restricts the movement of said locking member along said axial direction by touching to a bottom surface of said hollow space when said locking pin is moved in said axial direction toward said stopper member, and wherein a height of said second portion is provided so that said height is longer than a depth of said hollow space in said axial direction.

19. The apparatus according to clam 18, wherein said second portion is provided with a tapered surface in order that a diameter at said end face is smaller than a diameter at a root portion where said second portion is protruding from said first portion.

20. The apparatus according to claim 19, wherein said stopper member is made from synthetic resin, and wherein said locking member is made from high-strength steel having abrasion resistance.

21. A variable valve timing control apparatus for an internal combustion engine comprising:

an intake camshaft for operating an intake valve;

a housing member rotated in synchronism with a crankshaft, said housing member comprising a circular space provided in said housing member and at least one fan-shaped space radially extending from an outer circumferential surface of said circular space;

a vane rotor rotated in synchronism with said intake camshaft and accommodated in said housing member in order to relatively rotate with respect to said housing member, said vane rotor comprising radially extending at least one vane so as to divide each said at least one fan-shaped space into first chamber and second chamber;

a hole provided in said vane;

an engaging bore provided in said housing member; and a locking mechanism provided in said hole for fixing the rotational phrase between said housing member and said vane rotor, said locking mechanism defining an axial direction of movement and comprising:

a locking member comprising a leading head portion and a hollow space portion disposed along said axial direction, said hollow space portion comprising an opening which opens in an opposite direction to said leading head along said axial direction;

a stopper member comprising first portion and second portion disposed in said axial direction, said first portion and said second portion comprising a different diameter along said axial direction so that a diameter of said second portion is smaller than a diameter of said first portion, said second portion protruding from a side face of said first portion in order that said second portion is accommodated in said hollow space, an end face of said second portion restricting the movement of said locking member in said axial direction by touching to a bottom surface of said hollow space when said locking pin is moved toward said stopper member, a height of said second portion is provided in said axial direction so that said height is the same as a depth of said hollow space in said axial direction; and a coil spring provided in said axial direction between said locking member and said stopper member so as to surround said second portion, said coil spring urging said locking member in said axial direction toward said engaging bore in order that said leading head is accommodated in said engaging bore.

22. A variable valve timing control apparatus for an internal combustion engine comprising:

an intake camshaft for operating an intake valve;

a housing member rotated in synchronism with a crankshaft, said housing member comprising a circular space provided in said housing member and at least one fan-shaped space radially extending from an outer circumferential surface of said circular space;

a vane rotor rotated in synchronism with said intake camshaft and accommodated in said housing member in order to relatively rotate with respect to said housing member, said vane rotor comprising radially extending at least one vane so as to divide each said at least one fan-shaped space into first chamber and second chamber;

a hole provided in said vane;

an engaging bore provided in said housing member; and a locking mechanism provided in said hole for fixing the rotational phrase between said housing member and said vane rotor, said locking mechanism defining an axial direction of movement and comprising:

a locking member comprising a leading head portion and a hollow space portion disposed along said axial direction, said hollow space portion comprising an opening which opens in an opposite direction to said leading head along said axial direction;

a stopper member comprising first portion and second portion disposed in said axial direction, said first portion and said second portion comprising a different diameter along said axial direction so that a diameter of said second portion is smaller than a diameter of said first portion, said second portion protruding from a side face of said first portion in order that said second portion is accommodated in said hollow space, an end face of said second portion restricting the movement of said locking member in said axial direction by touching to a bottom surface of said hollow space when said locking pin is moved toward said stopper member, a height of said second portion is provided in said axial direction so that said height is longer than a depth of said hollow space in said axial direction; and a coil spring provided in said axial direction between said locking member and said stopper member so as to surround said second portion, said coil spring urging said locking member in said axial direction toward said engaging bore in order that said leading head is accommodated in said engaging bore.

* * * * *